United States Patent [19]

Chang

[11] Patent Number: 4,748,827

[45] Date of Patent: Jun. 7, 1988

[54] COIL SUPPORT STRUCTURE

[76] Inventor: Dick Y. K. Chang, 4406 Mountbatten Ct., Indianapolis, Ind. 46254

[21] Appl. No.: 67,349

[22] Filed: Jun. 29, 1987

[51] Int. Cl.[4] ..... F25D 21/00

[52] U.S. Cl. ..... 62/272; 62/298

[58] Field of Search ..... 62/272, 298, 262, 263, 62/259.1, 507, 285, 281

[56] References Cited

U.S. PATENT DOCUMENTS 3,668,887 6/1972 Riello ..... 62/262

4,471,633 9/1984 Tinsler ..... 62/298

4,637,223 1/1987 Hosoya et al. ..... 62/298

*Primary Examiner*—Henry A. Bennet

*Attorney, Agent, or Firm*—Dana F. Bigelow

[57] ABSTRACT

Vertical support for the coil within a base pan is provided by way of a plurality of raised support surfaces that are formed to define on the radially outward side an opening that facilitates the inwardly extending fastener which secures the protective grille to the base pan skirt. Damage that might otherwise be caused to the coil by the fastener, is thus avoided.

10 Claims, 4 Drawing Sheets

COIL SUPPORT STRUCTURE

BACKGROUND OF THE INVENTION

This invention relates generally to air conditioning apparatus and, more particularly, to a structure for supporting an air conditioning coil in the base pan portion thereof.

In so called split system or packaged air conditioning or heat pump units, outdoor and indoor coils are provided and are interconnected by way of refrigerant tubing. The outdoor coil generally contains the system compressor and controls, as well as the outdoor coil, fan and drive motor. A base pan is commonly provided at the bottom of the condenser coil for the primary purpose of containing the unit but also for the purpose of providing vertical support both for the compressor and for the coil. The upstanding coil is normally mounted with its lower edge near the periphery of the base pan.

Rather than placing the coil directly in the flat bottom of the base pan, where it will be more susceptible to being covered by the buildup of dirt and the like, and also to the corrosion that may result from the condensation and defrost residue that tends to collect in the base pan, the common approach is to put pedestals or risers between the base pan and the coil to slightly elevate the coil from the base pan bottom. Also, because of the tendency of electrolysis to occur between the dissimilar metals of the pedestal and the heat exchanger coil, a nonmetallic pad is often placed between the two. The common method of attaching the pedestals to the base pan has been by way of fasteners or by welding or brazing. All of these methods have therefore required additional fabrication steps to be performed after the forming of the base pan structure, thus incurring additional time, expense and materials.

Another consideration with regard to the raising up of the coil from the base pan structure is that having to do with the mounting and fastening of the protective grille around the outer side of the coil. In this regard, it is common to secure the grille to the base pan by the use of fasteners that connect the grille to the upstanding skirt at the periphery of the base pan. Unless the coil is raised within the base pan, the fasteners are likely to pass through the base pan skirt and into the coil to thereby damage it. Even if the coil is elevated such as by the use of pedestals mentioned hereinabove, the coil may sag at locations between the pedestals such that when the fasteners are inserted in the upstanding skirt, they may still penetrate the coil.

It is therefore an object of the present invention to provide an improved coil support structure for an air conditioning unit.

Another object of the present invention is the provision in an air conditioning unit for simply and economically supporting a coil in an elevated position within the base pan structure.

Yet another object of the present invention is the provision in an air conditioning base pan structure for simply including coil support structures without incurring time consuming fabrication and fastening steps.

Yet another object of the present invention is the provision in an air conditioning unit for securing the protective grille to the base pan without the risk of damaging the heat exchanger coil mounted therein.

Still another object of the present invention is the provision for an air conditioning base pan structure which is economical to manufacture and effective in use. These objects and other features and advantages become more readily apparent upon reference to the following description when taken in conjunction with the appended drawings.

SUMMARY OF THE INVENTION

Briefly, in accordance with one aspect of the invention, support for the heat exchanger coil to be mounted in the base pan structure of an air conditioning system is provided by way of a support structure comprising a generally horizontal, support surface that is raised up from the base pan structure and supported by generally upwardly extending riser walls that form the connection between the base pan structure and the support surface. The riser walls are formed in such a manner as to define, on the radially outer side of the support structure, a cavity of sufficient size as to receive a fastener extending inwardly from the outer grille and base pan skirt. These cavities are therefore effectively used to locate the fasteners that secure the outer grille structure to the base pan skirt, thereby insuring that the fasteners do not penetrate the coil mounted above. Even if the coil should sag between the support surfaces, since the fasteners are only installed directly below the support surfaces, they will never be placed at the point where the coil sags.

In accordance with another aspect of the invention, the support structure is formed at the time that the base pan structure is formed by the use of a die and press, with the generally horizontal support surface of the support structure being forced upwardly, together with three supporting riser walls, to form an integral structure. The fourth side of the generally horizontal support surface is open with the exposed edge of the support surface being at the top and the exposed edge of the base pan bottom, extending radially inwardly, being disposed at the bottom to jointly define the cavity for receiving the fastener end.

In accordance with yet another aspect of the invention, the coil support structure comprises an elastomeric device having a flat element to be positioned directly under the coil to be supported, a combination stem and bulbous portion for connection to the base pan, and an intermediate riser portion for interconnecting the two. The riser portion comprises a pair of crossed diagonal ribs which together define a radially outwardly extending cavity for receipt of the fastener. Provision is made to properly align the cavity in the rotational sense, by way of a shaped stem which fits into a correspondingly shaped hole in the base pan.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
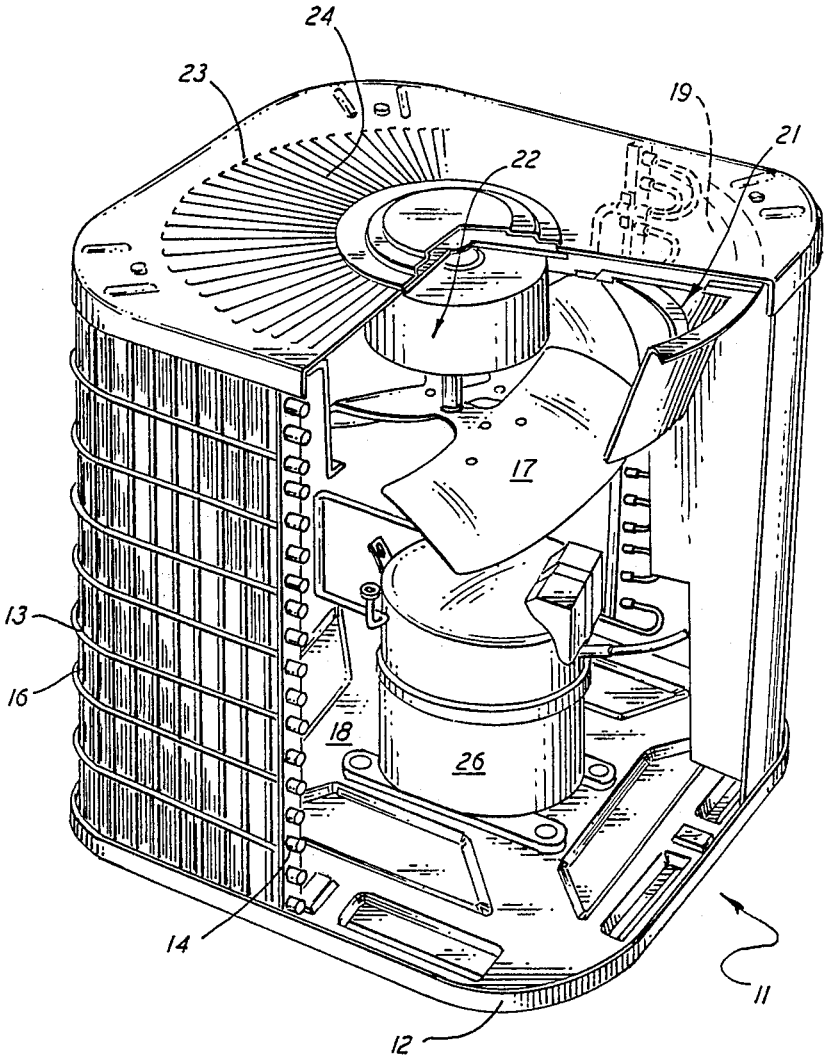
FIG. 1 is a perspective view of an air conditioning unit with a base pan in accordance with the present invention.

Referring now to FIG. 1, the present invention is shown generally at 11 as incorporated in a base pan 12 of a typical condensing unit 13 of an air conditioning or heat pump system having an indoor coil connected thereto by way of refrigerant piping.

The condensing unit 13 includes an upstanding coil 14 which together with its outer protective grille 16 defines the shape of the unit. Although the particular unit shown is generally square in shape, the coil and supporting base pan can just as well be round, or any other desirable shape, while remaining within the scope of the present invention. The coil 14 functions as a condenser coil to give up heat to the surrounding air during the periods in which the heat pump is operating in the cooling or defrost modes, while it functions as an evaporator coil to extract heat from the surrounding air during periods when the system is operating in a heating mode.

In order to promote the flow of air through the coil 14, a fan 17 is axially mounted at the top of the cavity 18 formed by the coil 14. Mounted around the fan 17 is an orifice ring 19 which defines an outwardly expanding orifice 21 to conduct the outward flow of air. Thus, as the fan 17 is driven by an electric motor 22 it draws the air into the coil 14 and out through the orifice 21. A cover 23 with a louvered opening 24 is mounted on the top of the unit for purposes of protection and support.

Also mounted in the cavity 18 is a compressor 26 and the various valves and piping necessary to fluidly connect it to both the indoor and outdoor coils. The compressor 26 is mounted to and supported by the base pan 12 as shown.

Figure 2:
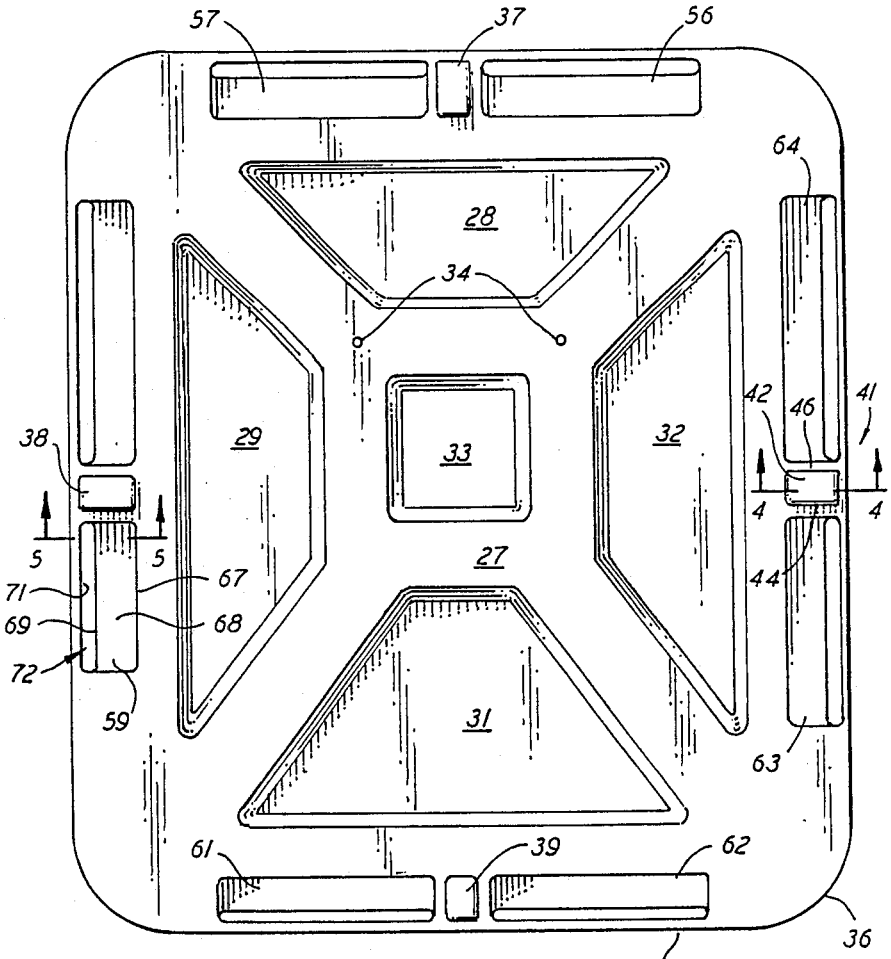
FIG. 2 is a top plan view of the base pan portion thereof.
Figure 3:
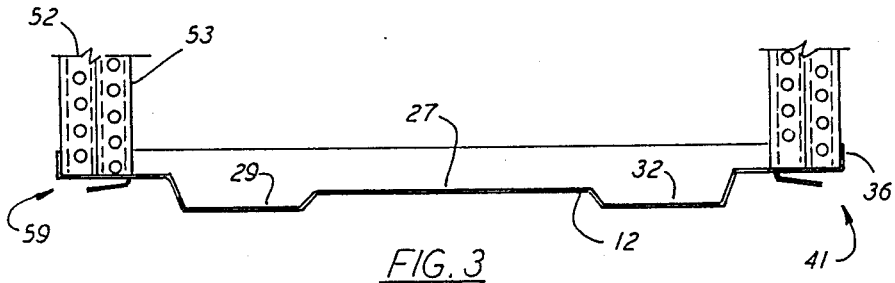
FIG. 3 is a front elevational view of the base pan portion thereof.

Referring now to FIGS. 2 and 3, the base pan 12 is shown as formed from a single piece of sheet metal with portions being deformed or stamped therein. The principal surface of the base pan is indicated at 27 and is at a raised or intermediate elevational level, whereas a plurality of lowered or depressed surfaces are provided at 28, 29, 31, 32 and 33 for the purpose of strengthening the base pan structure. Provision is made for centrally mounting the compressor 26 with bolts secured in the openings 34. An upstanding skirt 36 extends upwardly from the principal surface 27 and forms the outer perimeter of the base pan 12. Located proximate the midpoint of each side of the base pan 12 are the coil support structures as indicated at 37, 38, 39 and 41, respectively. The details of those structures are more clearly seen by reference to FIG. 4.

Figure 4:
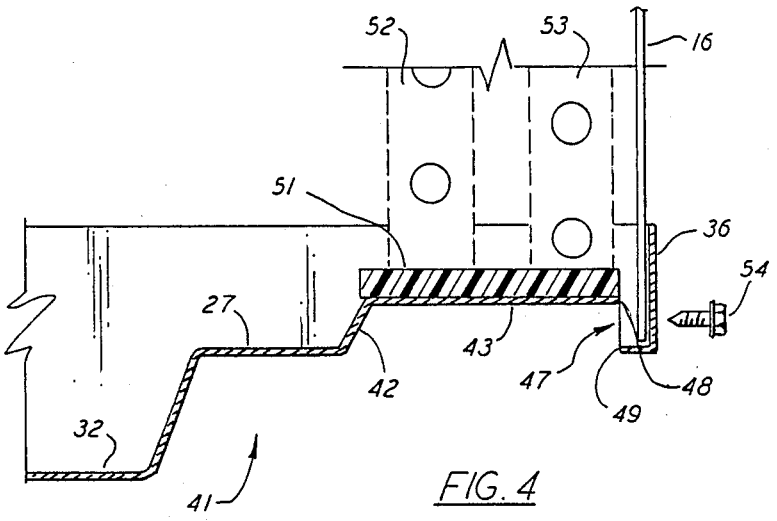
FIG. 4 is a sectional view of the coil support thereof, as seen along lines IV—IV of FIG. 2.

Referring to FIG. 4, it will be seen that, as the base pan extends outwardly toward the upstanding skirt 36, the profile raises from the lowered surface 32 to the principal surface 27 and then to the coil support structure 41 which includes the gradually rising inner wall 42 and a substantially horizontal pedestal surface 43. In addition to the gradually rising inner wall 42, the coil support structure 41 also includes the gradually rising side walls 44 and 46 as shown in FIG. 2. The entire coil support structure 41 is therefore integrally formed as part of the base pan structure with the pedestal surface 43 being supported on three of its sides. On the outer side thereof, an opening 47 is formed between the shelf end 48 and the exposed end 49 of that portion of the principal surface 27 extending inwardly from the upstanding skirt 36. Mounted on the horizontal pedestal surface is a nonmetallic pad 51 which is preferably attached thereto by way of an adhesive or the like. The integral horizontal pedestal surface 43, and the nonmetallic pad 51 then form the support structure for the entire vertical load of the inner row coil 52 and outer row coil 53 on that side of the unit. The coil support structures 37, 38 and 39 are identical to the coil support structure 41 as just described.

As mentioned hereinabove, a protective grille 16 surrounds the coil 14 and forms the outer boundary of the unit. This grille 16 is normally disposed with its lower end inside the upstanding skirt 36 as shown and is secured within that skirt by way of a plurality of fasteners 54. If the outer row coil 53 were permitted to rest on the base pan at the level of the principal surface 27, it then would be susceptible to being damaged by the fasteners 54 when they are inserted inwardly. However, the raised horizontal pedestal surface 43 elevates the outer row coil 53 to a height which is above the level in which the fasteners 54 are installed and thus out of the zone in which damage could occur to them. With the outer coil 53 being raised, the fasteners may be installed at any location around the periphery of the skirt 36. However, since the coil 53 will have a tendency to sag between adjacent supports, and may well sag to the point where it could be punctured by a fastener 54, the fasteners 54 are preferably installed only at the locations corresponding to those of the supports (i.e. at the openings 47) such that they will always be below the coil 53.

As mentioned hereinabove, when the unit is operating in the defrost mode, the heated refrigerant in the coil 14 functions to melt the frost that is formed thereon. As this frost is melted, it is necessary to dispose of the resulting water. Thus, a plurality of drainage openings, indicated at 56-64 in FIG. 2, are provided. Although there are two such drainage openings on each side of the base pan as shown in FIG. 2, it should be understood that drainage openings of other shapes, locations, configurations and sizes may be employed while remaining within the scope of the present invention. The particular structure of the drainage opening 59 in accordance with the present invention, and as representative of the other openings, is shown in FIG. 5.

Figure 5:
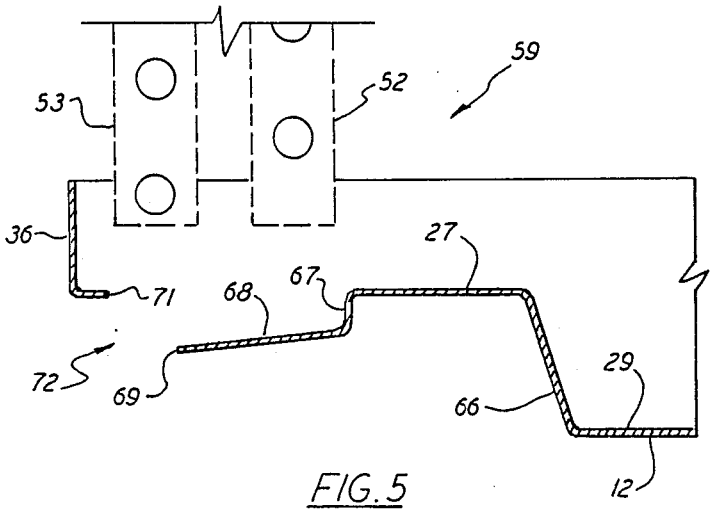
FIG. 5 is a sectional view of the drainage opening portion thereof as seen along lines V—V of FIG. 2.

Referring now to FIG. 5, as the profile of the base pan 12 extends radially outwardly, the lowered surface 29 transitions to a rising surface 66 and then to the principal surface 27. That surface then transitions to a stepped down surface 67 which extends downwardly to a slanted shelf 68. The end 69 of the shelf 68, together with the end 71 of that portion of the principal surface 27 extending inwardly from the upstanding skirt 36, define an opening 72 for drainage of the water resulting from defrosting of the coils. Such a drainage opening can be used with either a single or a dual coil installation to obtain adequate drainage while at the same time preventing any sparks or hot metal from passing through the opening. For example, in a single coil installation, the single coil would be located in the position of the outer coil 53 as shown in FIG. 5. Since the coil is located directly over the opening 72, the water will drip directly from the coil to the opening 72. For purposes of protection against the downward movement of hot materials, the coil 53 and the slanted shelf 68 serve to provide a barrier against the hot materials that could fall directly through the opening 72. In a dual coil application, the outer coil 53 is located in the same position and performs in the same manner as described hereinabove. The inner coil 52 is now located over the slanted shelf 68 such that the residue from defrost can drip directly onto the shelf 68 and then run down to the opening 72. Again, the coils 52 and 53, together with the slanted shelf 68 tend to act as a barrier against the downward movement of hot materials.

Figure 6:
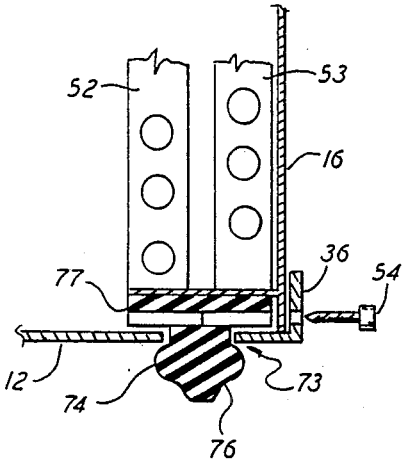
FIG. 6 is a sectional view of a modified embodiment of the coil support portion of the base pan.

Referring now to FIG. 6, an alternative embodiment of the coil support structure is shown. Here, the base pan 12 has a square opening 73 formed therein near the upstanding skirt 36. An elastomeric pedestal 74 is installed in the opening 73, with its bulbous portion 76 below and its flat portion 77 above the base plate 12. The inner and outer coils 52 and 53, respectively then rest on the flat portion 77, to thereby receive vertical support, but remain insulated, from the base pan 12.

Figure 7:
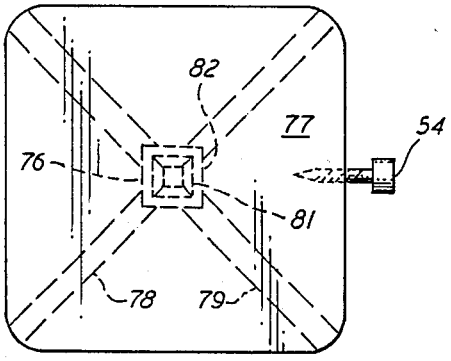
FIG. 7 is a top view of the coil support element.
Figure 8:
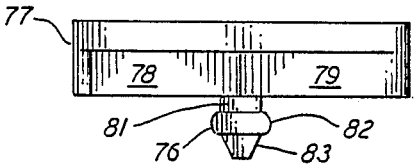
FIG. 8 is a front view thereof.

The particular structure of the elastomeric pedestal 74 is shown in FIGS. 7 and 8. It will be seen that the flat portion 77 includes downwardly extending diagonal ribs 78 and 79 which tend to rest directly on the base pan 12. At the crossing of those ribs, a square shaped stem 81 extends downwardly to fit snugly within the square opening 73 of the base pan 12, and below that the bulbous portion 76 includes a convex portion 82 and a tapered portion 83 to facilitate the easy installation into, and the retaining within, the square opening 73. The elastomeric pedestal 74 is thus simply installed by forcing the bulbous portion 76 downwardly through the square opening 73 until the convex portion 82 has passed therethrough, with its upper side resting against the underside of the base pan 12 to thereby retain it in the installed position.

As mentioned, the square stem 81 fits snugly into the square opening 73 to thereby precisely locate the pedestal 74 in its proper rotational position at any one of four possible orientations. It will thus be recognized that in any one of these four possible positions, the diagonal ribs 78 and 79 will be so disposed that the space defined therebetween is properly located and oriented with respect to the fastener 54 that passes through the upstanding skirt 36 to secure the grille 16 in place. Of course, other shapes such as a triangle could be used in the same manner.

Figure 9:
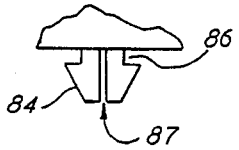
FIG. 9 is a modified embodiment thereof.

An alternative embodiment to the bulbous portion 76 of the elastomeric pedestal 74 is shown in FIG. 9. Rather than providing the convex portion 82, a tapered portion 84 extends all the way to the stem portion 86 and the entire structure is expanded by way of a gap 87. Installation of the pedestal 74 is therefore accomplished by depressing the two halves 84 and 86 together to close the gap 87, and then after the wings of the tapered portion 87 have passed through the formed opening 73, they will tend to spring radially outwardly to lock the element in place.

While the present invention has been described with particular reference to preferred and modified embodiments, the concepts of the invention are readily adaptable to other embodiments, and those skilled in the art may vary the structure thereof without departing from the essential spirit of the present invention.

What is claimed is:

1. In an air conditioning apparatus of the type having at least one heat exchanger coil mounted above and being supported by a base pan having a grille attached to its periphery by a fastener, an improved coil support means comprising:

a riser portion being integrally formed with and extending upwardly from the base pan; and a support portion integrally formed with said riser portion, and being substantially horizontal and adapted to vertically support the weight of the coil, wherein said riser portion is so formed as to define a cavity for receiving the end of the fastener projecting inwardly from the grille and base pan periphery.

2. A coil support as set forth in claim 1 wherein there is attached to said support portion a nonmetallic portion to prevent chemical reaction between the coil and the support means.

3. A coil support means as set forth in claim 1 wherein said coil support means is adapted to support multiple coils.

4. A coil support means as set forth in claim 1 wherein said base pan includes a plurality of drainage openings and further wherein said coil support means is disposed between a pair of said openings.

5. In an air conditioning apparatus of the type having a base pan, a heat exchanger coil supported by the base pan, and a grille mounted by way of a fastener to a portion of the base pan to enclose the coil, an improved coil support structure comprising:

a substantially horizontal support element for placement between the base pan and heat exchanger coil so as to provide vertical support for the coil;

a riser element connected to said horizontal support element and extending downwardly to engage the base pan, said riser element being formed so as to define, on the radially outer side of the coil support structure, a cavity for receiving the end of the fastener therein; and attachment means for attaching said support and riser elements to said bar pan, wherein said attachment means comprises a stem connected to and extending downwardly from said riser element to project through a hole formed in the base pan, and an enlarged portion extending further downwardly from said stem portion and being larger than said opening, said enlarged portion being deformable to permit its insertion through said opening and then acting, in its undeformed state, to retain the coil support in its installed position.

6. An improved coil support structure as set forth in claim 5 wherein said substantially horizontal support element includes a nonmetallic portion in direct contact with said coil.

7. An improved coil support structure as set forth in claim 1 wherein said support portion is supported on at least two sides, and said riser portion comprises at least two generally upwardly extending walls that integrally connect the support portion to the base pan.

8. An improved coil support structure as set forth in claim 5 wherein said coil support structure is composed of an elastomeric material.

9. An improved coil support structure as set forth in claim 5 wherein said riser element comprises a pair of crossed, diagonal ribs that form a triangular cavity therebetween.

10. An improved coil support structure as set forth in claim 5 wherein both said stem and said opening are formed with at least three sides, and wherein the sides of the stem conform with those of the opening, such that the relative rotational positioning is maintained to ensure that the cavity is aligned with the fastener.

* * * * *